United States Patent [19]

Trousdell

[11] 4,378,961

[45] Apr. 5, 1983

[54] CASE ASSEMBLY FOR SUPPORTING STATOR VANES

[75] Inventor: Edmund D. Trousdell, Tolland, Conn.

[73] Assignee: United Technologies Corporation, Hartford, Conn.

[21] Appl. No.: 258,066

[22] Filed: Apr. 27, 1981

Related U.S. Application Data

[63] Continuation of Ser. No. 2,502, Jan. 10, 1979, abandoned.

[51] Int. Cl.[3] ..... F01D 25/26

[52] U.S. Cl. ..... 415/137

[58] Field of Search ..... 415/134, 136–139, 415/115, 116, 119

[56] References Cited

U.S. PATENT DOCUMENTS 2,681,788 6/1954 Wosika ..... 415/137

2,925,998 2/1960 Hayes et al. ..... 415/137

*Primary Examiner*—Philip R. Coe

*Assistant Examiner*—Timothy F. Simone

*Attorney, Agent, or Firm*—Gene D. Fleischhauer

[57] ABSTRACT

A case assembly for supporting stator vanes of a gas turbine engine is disclosed. Various construction details and techniques which enable support of the vanes across the flow path of the engine are discussed. The construction details and techniques which provide damping to the vanes and accommodate differential thermal expansion between the vanes and the case assembly are developed. The vane mounting system disclosed is built around the concept of enabling sliding friction between components of the case assembly to dampen vane vibrations.

5 Claims, 4 Drawing Figures

FIG. 2
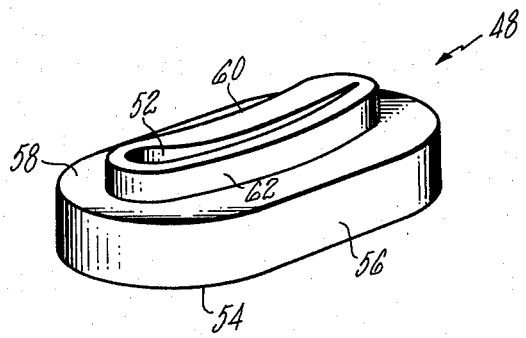
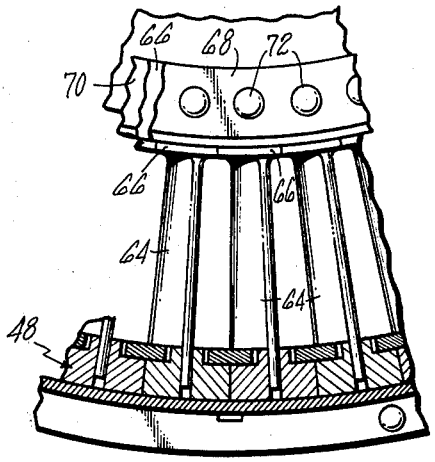
FIG. 4

CASE ASSEMBLY FOR SUPPORTING STATOR VANES

This is a continuation of application Ser. No. 2,502 filed Jan. 10, 1979, now abandoned.

BACKGROUND OF THE INVENTION

This invention relates to gas turbine engines and more particularly to the support of stator vanes in such an engine.

A gas turbine engine has a compression section, a combustion section and a turbine section. A rotor extends axially through the turbine section and the compression section. Rows of rotor blades extend outwardly from the rotor. A stator circumscribes the rotor. The stator includes an engine case assembly and rows of stator vanes supported from the case assembly.

Patents showing such constructions are U.S. Pat. No. 3,867,066 to Canova et al. entitled "Gas Compressor" and U.S. Pat. No. 2,997,275 to Bean et al. entitled "Stator Structure For Axial Flow Fluid Machine".

Differences in thermal growth between the vane and the case assembly cause thermal stresses. Vibrations in the vanes cause vibratory stresses. Accordingly, scientists and engineers seek support structures having an ability to dampen vane vibration and to accommodate differences in thermal growth between the case assembly and the stator vanes.

SUMMARY OF THE INVENTION

A primary object of the present invention is to support an array of stator vanes from a case assembly. Another object is to dampen vibrations in the array of stator vanes. A further object is to provide effective sealing between the vane and the support for the vane. In one detailed embodiment, an object is to improve the fatigue life of the airfoil by both damping vibrations in the airfoil and accommodating differences in thermal growth between the airfoil and the case assembly.

According to the present invention, a case assembly of a gas turbine engine has a plurality of circumferentially adjacent blocks which are slidably trapped within the case assembly and which engage the ends of corresponding stator vanes to support the vanes and to provide vane damping.

A primary feature of the present invention is a plurality of blocks which are slidably trapped between a wall element and a band. In one detailed embodiment, the block is slidable with respect to the vane. The block slides on the vane in the spanwise direction. Another feature is an aperture in the case. In one detailed embodiment the aperture is adapted to receive a correspondingly shaped projecting edge of the block.

A principal advantage of the present invention is the effective damping of vibrations. Vibratory damping results from sliding contact between each block and the wall element, the band and adjacent blocks. Another advantage is an effective seal against leakage of gas path air from a region of higher pressure to a region of lower pressure which results from the positive contact between the block and the vane, the wall element and the band. One detailed embodiment enables both the effective damping of vibrations and the accommodation of thermal growth between the vane and the case assembly. Differences in thermal growth between the vane and the case assembly are accommodated by the block which freely slides on the vane. Additional damping results from sliding contact between the block and each vane.

The foregoing and other objects, features and advantages of the present invention will become more apparent in the light of the following detailed description of the preferred embodiments thereof as discussed and illustrated in the accompanying drawing.

BRIEF DESCRIPTION OF THE DRAWING

FIG. 2 is a perspective view of a block of the type which engages a corresponding stator vane.

FIG. 4 is a sectional view of the vane and case assembly taken along the line 4—4 as shown in FIG. 1.

DESCRIPTION OF THE PREFERRED EMBODIMENT

A gas turbine engine embodiment of the invention is described. The invention is equally suited for use in both compressors and turbines.

Figure 1:
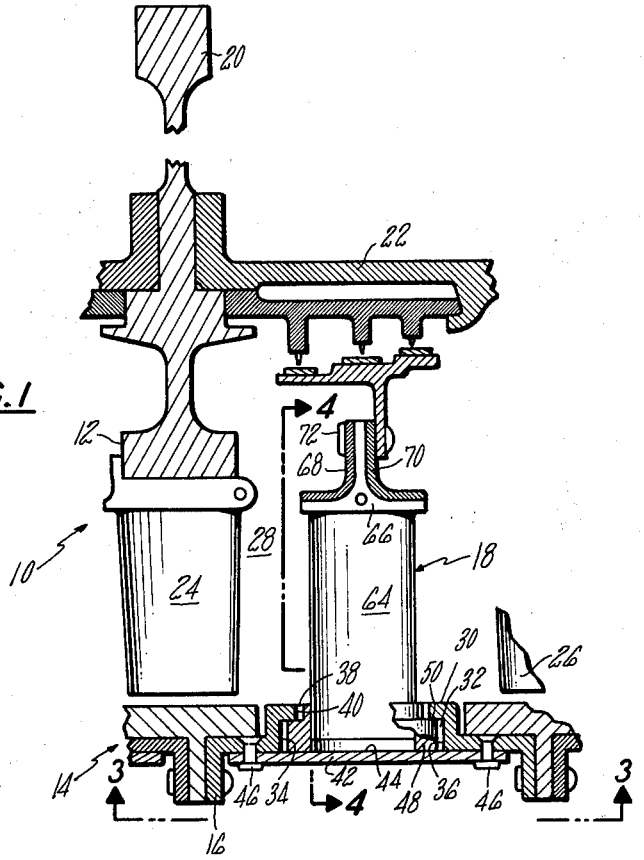
FIG. 1 is a simplified cross section view of a portion of a gas turbine engine showing a stator vane mounted in the engine case assembly with a portion of the vane removed.

FIG. 1 illustrates a portion of a compression section 10 of a gas turbine engine. A portion of a rotor assembly 12 and of a stator assembly 14 are shown. The stator assembly includes an engine case assembly 16 which circumscribes the compression section and a plurality of stator vanes, as represented by the single stator vane 18, which extends inwardly from the case assembly. The rotor assembly includes one or more rotor disks 20 which are separated by spacer elements 22. A first row of rotor blades, as represented by the single blade 24, extends outwardly from the rotor disk into proximity with the case assembly. A second row of rotor blades, as represented by the single rotor blade 26, extends outwardly into proximity with the case assembly. An annular flow path 28 for working medium gases extends axially through the compression section between the alternating rows of blades and vanes. The case assembly has a wall element 30 having an outwardly facing slot 32 which extends circumferentially about the exterior of the wall element. The slot has an upstream face 34 and a downstream face 36. A plurality of apertures, as represented by the single aperture 38, extend inwardly through the wall element. Each aperture has a face 40. A band element such as band 42 having an inwardly facing surface 44 circumscribes the wall element. The band is affixed to the wall element by attaching means such as the plurality of rivets 46. A plurality of blocks, as represented by the single block 48, are trapped between the wall element and the band. The wall element has a surface 50 facing the block. In the embodiment shown the surface 50 faces outwardly.

As shown in the FIG. 2 perspective view, each block has a hole 52 which is airfoil-shaped to conform closely to the vane 18 and which is adapted to slidably engage the vane. The block has an outwardly facing surface 54, a side 56 and a surface 58 facing the wall element. In the embodiment shown, the surface faces inwardly. The block has a shoulder 60 having a curved side 62.

Figure 3:
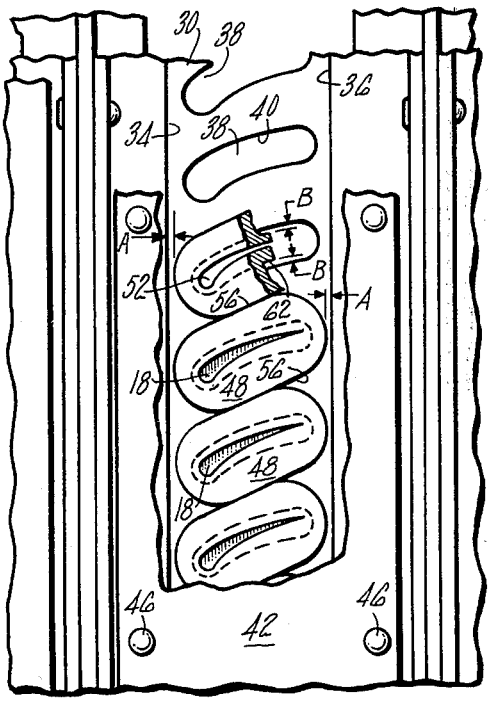
FIG. 3 is a directional view taken along the line 3—3 as shown in FIG. 1 including portions broken away to reveal the mounting of the vanes in the case assembly.

As shown in FIG. 3, the side 56 of each block 50 slidably engages the sides 56 of the adjacent blocks. In the installed condition, each block is spaced axially from the upstream face 34 of the slot and the downstream face of the slot 36 leaving a gap A therebetween. The curved side 62 of the shoulder 60 is spaced circumferentially from the face 40 of the aperture leaving a gap B therebetween.

As shown in FIG. 4, each vane 18 has an airfoil 64 and an integral flange 66 having a T-shape. The flanges 66 of adjacent vanes are joined together by two curved rings, as represented by the upstream curved ring 68 and the downstream curved ring 70. A rivet 72 passes through each ring and a corresponding flange.

During operation of the gas turbine engine, gases entering the compression section 10 flow along the annular flow path 28. The rotor assembly does work on the gases and causes the pressure and temperature of the gases to rise. As the hot gases lose heat to components in the compression section, the temperature of each component rises and the components expand thermally. Components, such as the stator vanes 18 and the case assembly 16, expand at different rates. These differences in thermal growth are accommodated by the block 48 sliding with respect to the airfoil 64 of the vane. The hole 52 in the block is adapted to receive the airfoil. The block closely conforms to the shape of the vane 18. In embodiments wherein the vane has an integrally formed flange or platform, the block engages the flange or platform in a manner similar to the embodiment of the airfoil described. In one detailed embodiment, a vane engaging such a block was designed to have an airfoil made of an iron and nickel-base alloy sheet stock. A block was designed to be cast around the airfoil to ensure close conformance to the airfoil contour. A thin refractory coating, which resists molten metal cast thereabout, may be applied to ensure a slidable engagement between the block and the airfoil. Such a coating may be a metal oxide, such as yttrium oxide, or boride, or the like which resists the molten metal.

The close conformance of the airfoil 64 to the block 48 provides an effective seal against leakage of gases from the working medium flow path. Leakage of the working medium gases is blocked by the positive contact between the surface 50 of the wall element 30 which faces the blocks and the surface 58 facing the wall element on the block 50. Leakage is blocked by the positive contact between the outwardly facing surface 54 of the block and the inwardly facing surface 44 of the band.

In the vibrational mode, the block slides within the gaps A and B to dissipate vibrational energy from the vane through friction. The friction results from the sliding contact between adjacent blocks and between each block and the adjacent components. The block slides with respect to the airfoil 64, with respect to the surface 50 of the wall element 30, and with respect to the inwardly facing surface 44 of the band 42. The friction turns vibrational energy into energy in the form of heat. The heat is conducted away from the block to the wall element 30.

Although this invention has been shown and described with respect to a preferred embodiment thereof, it should be understood by those skilled in the art that various changes and omissions in the form and detail thereof may be made therein without departing from the spirit and scope of the invention. For example, the airfoil may have a flange which is engaged by the block.

Having thus described a typical embodiment of my invention, that which I claim as new and desire to secure by Letters Patent of the United States is:

1. In a gas turbine engine of the type having an engine case assembly and a plurality of vanes extending in a substantially radial direction therefrom, the improvement which comprises:

a case assembly having a wall element, a band element extending circumferentially about the wall element and a plurality of blocks trapped radially between the band element and the wall element by said band element and said wall element wherein each of said blocks is adapted to engage one of said vanes and is slidable in a generally circumferential direction on one of said elements to dissipate vibratory energy in the vane.

2. The invention according to claim 1 wherein:

the wall element has a slot extending circumferentially about the wall element having an upstream face and a downstream face and wherein the block is disposed between the upstream face and the downstream face and is slidable therebetween.

3. The invention according to claim 2 wherein the block has a generally circumferentially extending surface facing the wall element and the wall element has a surface facing the block which engages the surface of the wall element.

4. The invention according to claims 1, 2 or 3 wherein the block is adapted to slidably engage the vane and to closely conform to the vane.

5. The invention according to claim 4 wherein:

the wall element has a plurality of apertures, each having a face and each of said blocks has a shoulder extending into the aperture.

* * * * *